US010878774B2

(12) United States Patent
Im et al.

(10) Patent No.: US 10,878,774 B2
(45) Date of Patent: Dec. 29, 2020

(54) DISPLAY DEVICE AND DRIVING METHOD THEREOF

(71) Applicant: Samsung Display Co., Ltd., Yongin-si (KR)

(72) Inventors: Tae Gon Im, Yongin-si (KR); Myeong Su Kim, Yongin-si (KR); Bo Yeon Kim, Yongin-si (KR); Sun Koo Kang, Yongin-si (KR); Yong Bum Kim, Yongin-si (KR); Dong Won Park, Yongin-si (KR); Jung Hwan Cho, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 17 days.

(21) Appl. No.: 16/287,499

(22) Filed: Feb. 27, 2019

(65) Prior Publication Data

US 2019/0304397 A1 Oct. 3, 2019

(30) Foreign Application Priority Data

Apr. 2, 2018 (KR) ..... 10-2018-0038272

(51) Int. Cl.
*G09G 5/00* (2006.01)
*G09G 3/36* (2006.01)
*G09G 3/3275* (2016.01)

(52) U.S. Cl.
CPC ..... *G09G 5/008* (2013.01); *G09G 3/3275* (2013.01); *G09G 3/3685* (2013.01); *G09G 2310/027* (2013.01); *G09G 2310/08* (2013.01)

(58) Field of Classification Search
None
See application file for complete search history.

(56) References Cited

U.S. PATENT DOCUMENTS

2006/0132652 A1 6/2006 Kim
2009/0284455 A1* 11/2009 Jung ..... G09G 3/3611 345/87
2011/0242066 A1* 10/2011 Jeon ..... G09G 5/008 345/204
2016/0351129 A1* 12/2016 Kim ..... G09G 3/3258
2016/0379588 A1* 12/2016 Kim ..... G09G 3/3696 345/214

FOREIGN PATENT DOCUMENTS

KR 10-0665060 B1 1/2007

* cited by examiner

*Primary Examiner* — Christopher J Kohlman
(74) *Attorney, Agent, or Firm* — Lewis Roca Rothgerber Christie LLP

(57) ABSTRACT

A display device includes a timing controller configured to supply a first set signal to a data control signal line in a first frequency mode, and to supply a second set signal and a data signal to the data control signal line in a second frequency mode that is different from the first frequency mode, a data driver configured to recover the data signal supplied to the data control signal line according to a signal recovery characteristic value, to generate a plurality of data voltages based on the recovered data signal, and to adjust the signal recover characteristic value based on the first set signal and the second set signal, and a display unit including a plurality of pixels that emit lights with gray scales corresponding to the plurality of data voltages.

19 Claims, 7 Drawing Sheets

DISPLAY DEVICE AND DRIVING METHOD THEREOF

CROSS-REFERENCE TO RELATED APPLICATION

The present application claims priority to, and the benefit of, Korean Patent Application No. 10-2018-0038272 filed on Apr. 2, 2018 in the Korean Intellectual Property Office, the entire disclosure of which is incorporated herein by reference.

BACKGROUND

1. Field

The present disclosure generally relates to a display device and a driving method thereof.

2. Description of the Related Art

With the development of information technologies, the importance of a display device that is a connection medium between a user and information increases. Accordingly, display devices such as a liquid crystal display device and an organic light emitting display device are increasingly used.

A display device displays a target image to a user by writing a data voltage for expressing a target gray scale in each pixel, and by allowing an organic light emitting diode to emit light, or by allowing light of a backlight unit to be polarized by controlling orientation of liquid crystals, corresponding to the data voltage.

The data voltage is generated from a data driver. For the data driver to stably generate a plurality of data voltages, it is suitable to accurately sample a plurality of pixel data supplied from a timing controller using a clock signal.

The data driver includes at least one driver circuit for supplying a data voltage to a data line. In addition, the driver circuit includes a signal recovery unit for recovering a data signal received from the timing controller.

When the driving frequency of the timing controller and the data driver is a high frequency, noise in the data signal may increase.

SUMMARY

Embodiments provide a display device and a driving method thereof, which can improve a data signal recovery rate.

According to an aspect of the present disclosure, there is provided a display device including a timing controller configured to supply a first set signal to a data control signal line in a first frequency mode, and to supply a second set signal and a data signal to the data control signal line in a second frequency mode that is different from the first frequency mode, a data driver configured to recover the data signal supplied to the data control signal line according to a signal recovery characteristic value, to generate a plurality of data voltages based on the recovered data signal, and to adjust the signal recover characteristic value based on the first set signal and the second set signal, and a display unit including a plurality of pixels that emit lights with gray scales corresponding to the plurality of data voltages.

A first operating frequency in the first frequency mode may be lower than a second operating frequency in the second frequency mode.

The timing controller may be configured to the data signal having a high or low level to the data control signal line while a frequency mode is being changed.

The timing controller may be configured to transmit a training notification signal to the data driver before the first and second set signals are transmitted to the data control signal line.

The timing controller might not transmit the training notification signal to the data driver while a frequency mode is being changed.

The data driver may be configured to indicate to the timing controller whether Phase Loop Lock (PLL) has failed using a feedback signal.

The timing controller may be configured to change a frequency mode from the second frequency mode to the first frequency mode when the feedback signal is received.

The timing controller may be configured to continue to operate in the second frequency mode when the feedback signal is received, and to change the frequency mode from the second frequency mode to the first frequency mode when the feedback signal is again received.

The data driver may include a plurality of driver circuits configured to supply the plurality of data voltages to the plurality of pixels, and each of the plurality of driver circuits may include a signal recovery unit configured to recover a signal supplied to the data control signal line.

The signal recovery characteristic value may represent at least one of DC and AC gains of the signal recovery unit.

The signal recovery unit may be configured to recover data control signals supplied to the data control signal line by filtering the data control signals according to the signal recovery characteristic value.

According to another aspect of the present disclosure, there is provided a method for driving a display device, the method including supplying, by a timing controller, a first set signal to a data control signal line in a first frequency mode, adjusting, by a data driver, a signal recovery characteristic value based on the first set signal, changing, by the timing controller, a frequency mode from the first frequency mode to a second frequency mode that is different from the first frequency mode, supplying, by the timing controller, a second set signal and a data signal to the data control signal line in the second frequency mode, again adjusting the signal recovery characteristic value based on the second set signal, recovering, by the data driver, the data signal according to the signal recovery characteristic value, generating, by the data driver, a plurality of data voltages based on the recovered data signal, and emitting, from a plurality of pixels, lights with gray scales corresponding to the plurality of data voltages.

A first operating frequency in the first frequency mode may be lower than a second operating frequency in the second frequency mode.

The method may further include supplying, with the timing controller, a data signal having a high or low level to the data control signal line while a frequency mode is being changed.

The method may further include transmitting, with the timing controller, a training notification signal to the data driver before the first and second set signals are transmitted to the data control signal line.

The timing controller might not transmit the training notification signal to the data driver while the frequency mode is being changed.

The method may further include indicating with a feedback signal, from the data driver to the timing controller, whether Phase Loop Lock (PLL) has failed.

The method may further include changing, by the timing controller, the frequency mode from the second frequency mode to the first frequency mode when the feedback signal is received.

The method may further include having the timing controller operate in the second frequency mode when the feedback signal is received, and change the frequency mode from the second frequency mode to the first frequency mode when the feedback signal is again received.

According to still another aspect of the present disclosure, there is provided a display device including a timing controller configured to transmit a training notification signal having a first set pattern to a data control signal line in a first frequency mode, and to supply the training notification signal having a second set pattern and a data signal to the data control signal line in a second frequency mode that is different from the first frequency mode, a data driver configured to recover the data signal supplied to the data control signal line according to a signal recovery characteristic value, to generate a plurality of data voltages based on the recovered data signal, and to adjust the signal recovery characteristic value based on the first set pattern and the second set pattern, and a display unit including a plurality of pixels configured to emit lights with gray scales corresponding to the plurality of data voltages.

BRIEF DESCRIPTION OF THE DRAWINGS

Features of the inventive concept and methods of accomplishing the same may be understood more readily by reference to the following detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present invention.

Figure 1:
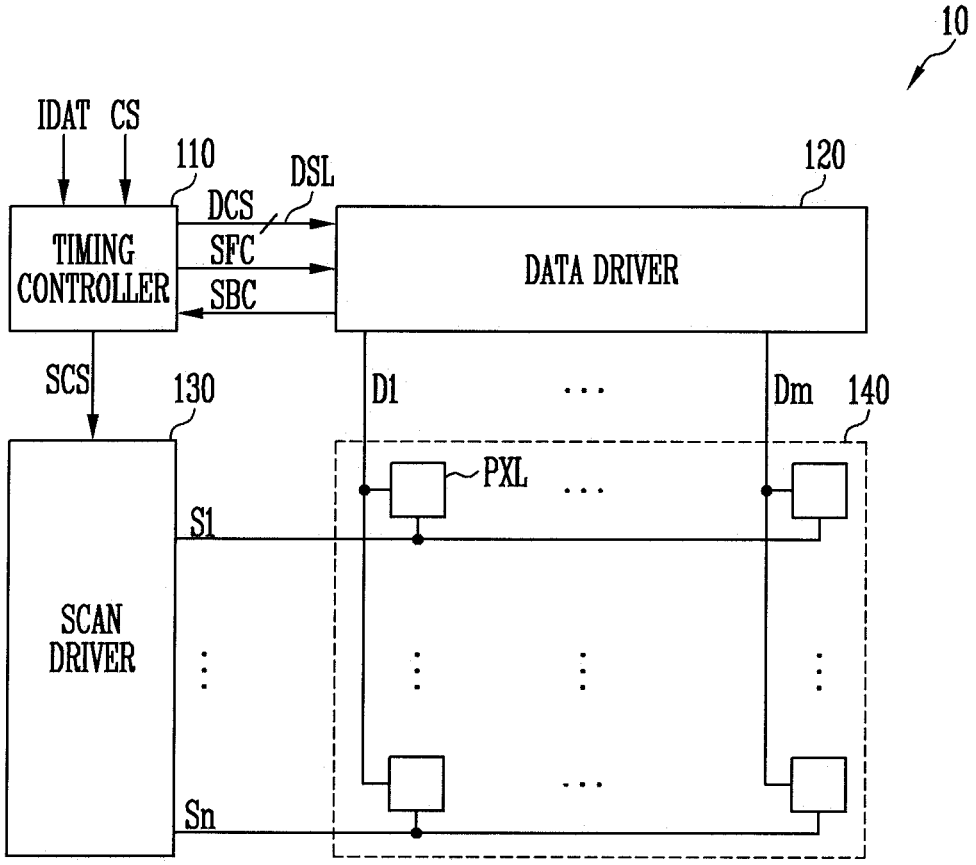

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (e.g., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a diagram illustrating a display device according to an embodiment of the present disclosure.

Figure 2:
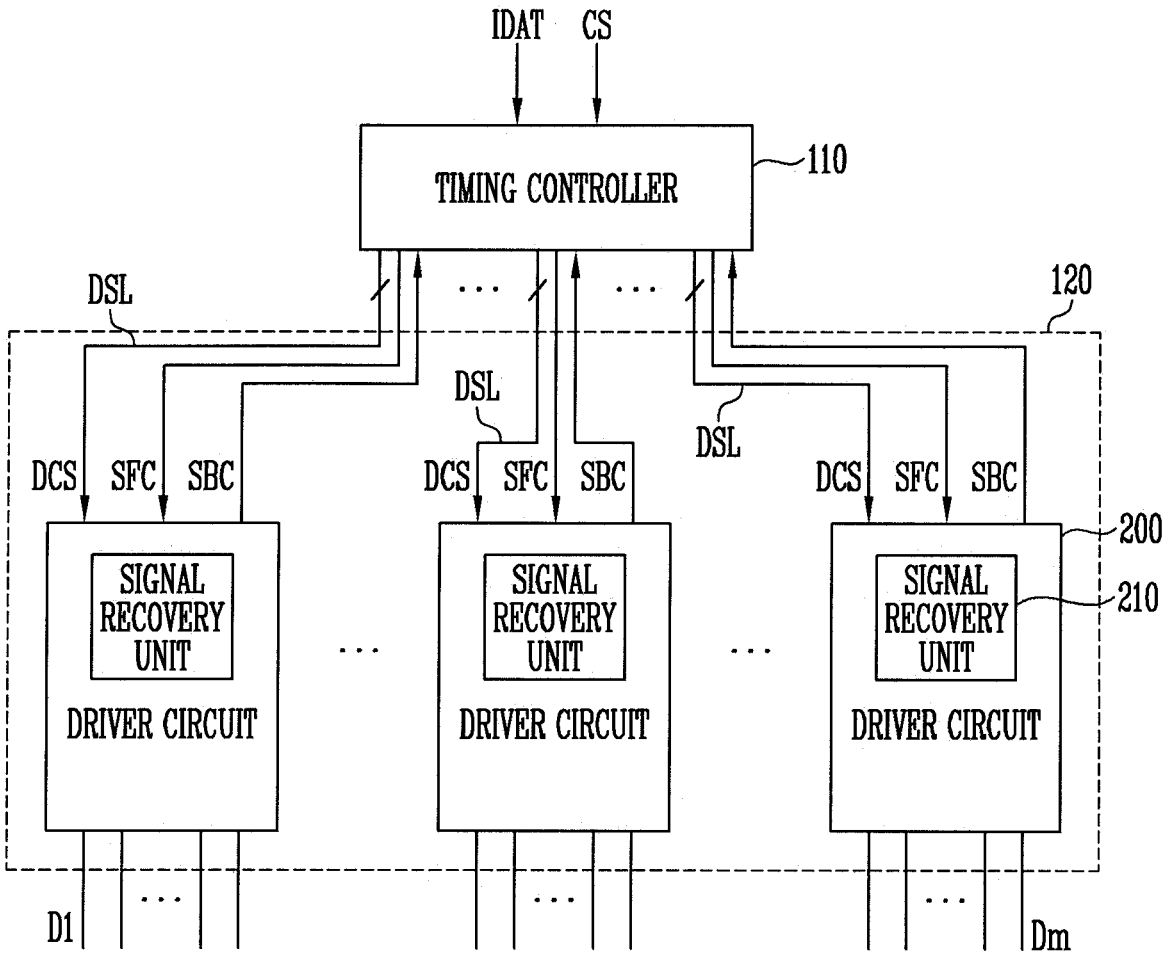

FIG. 2 is a data driver according to an embodiment of the present disclosure.

Figure 3:
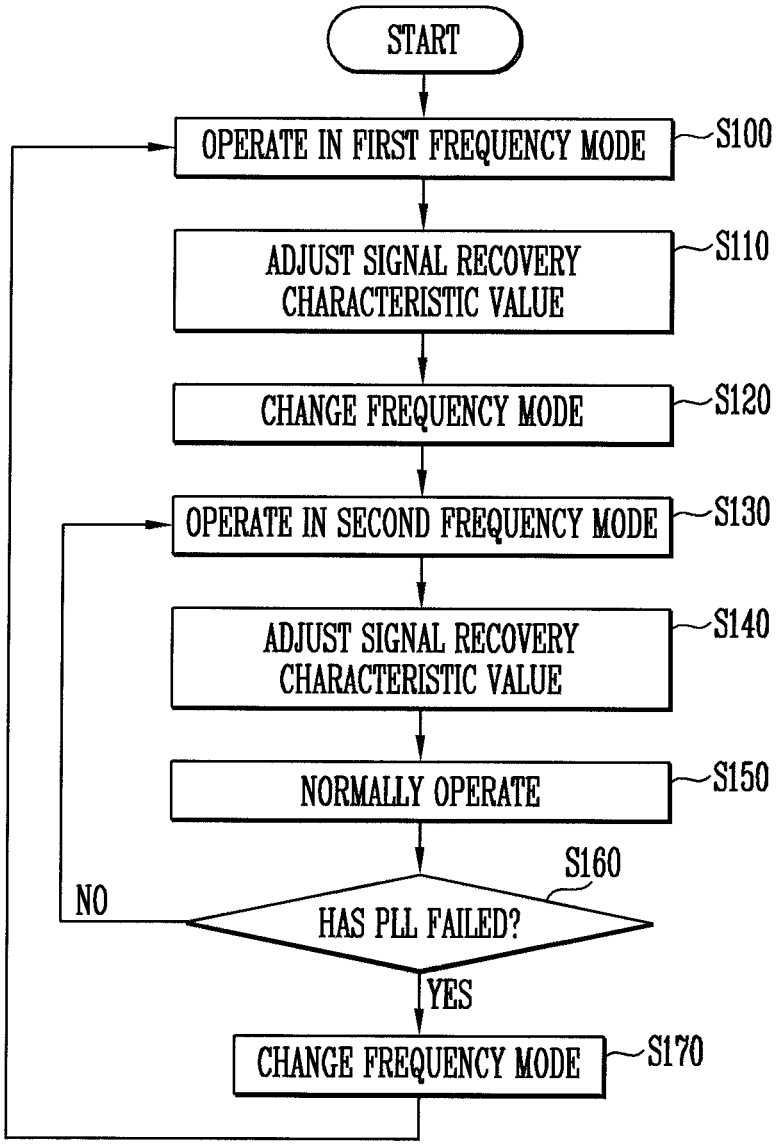

FIG. 3 is a flowchart illustrating a driving method of the display device according to an embodiment of the present disclosure.

Figure 4A:
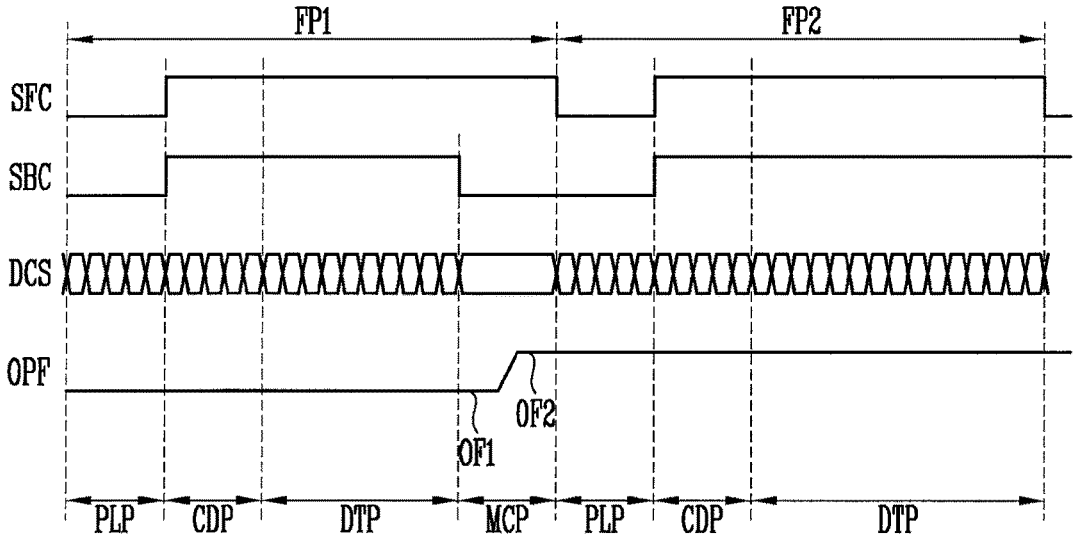
Figure 4B:
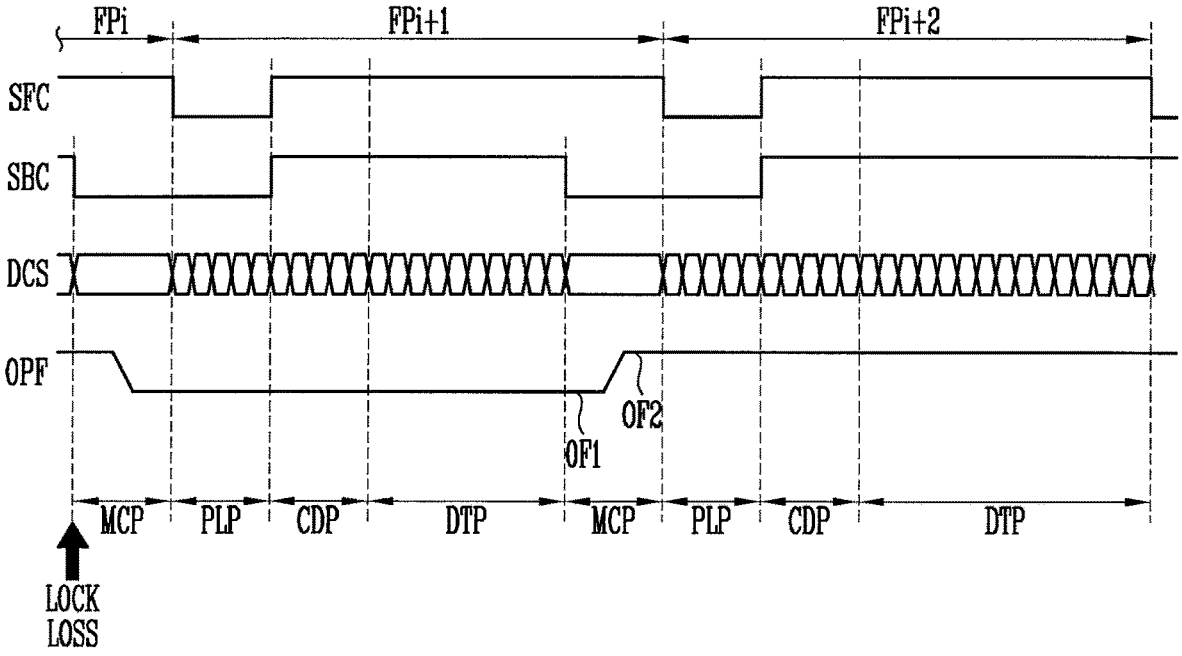

FIGS. 4A and 4B are waveform diagrams illustrating the driving method shown in FIG. 3.

Figure 5:
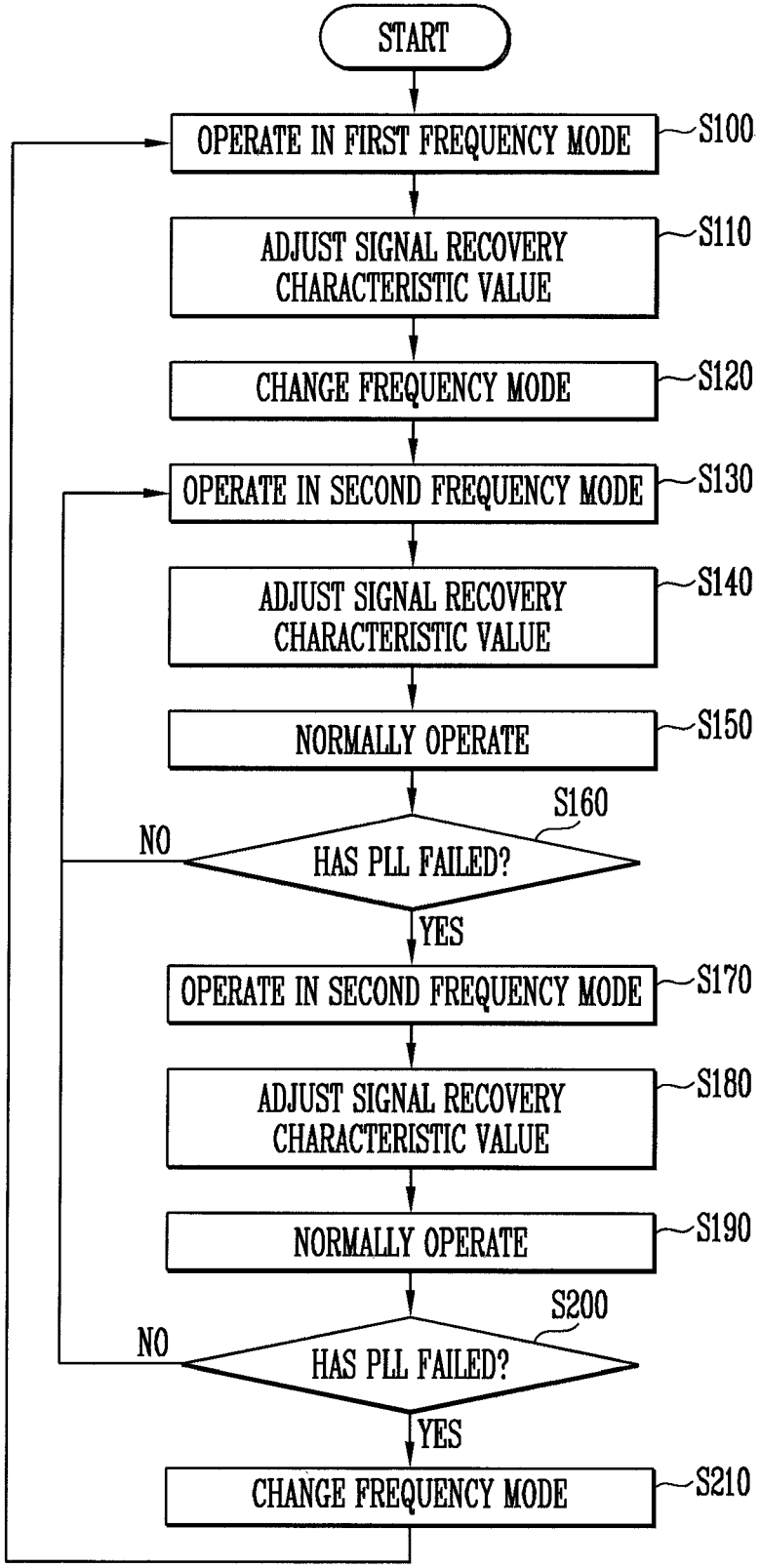

FIG. 5 is a flowchart illustrating a driving method of the display device according to an embodiment of the present disclosure.

Figure 6:
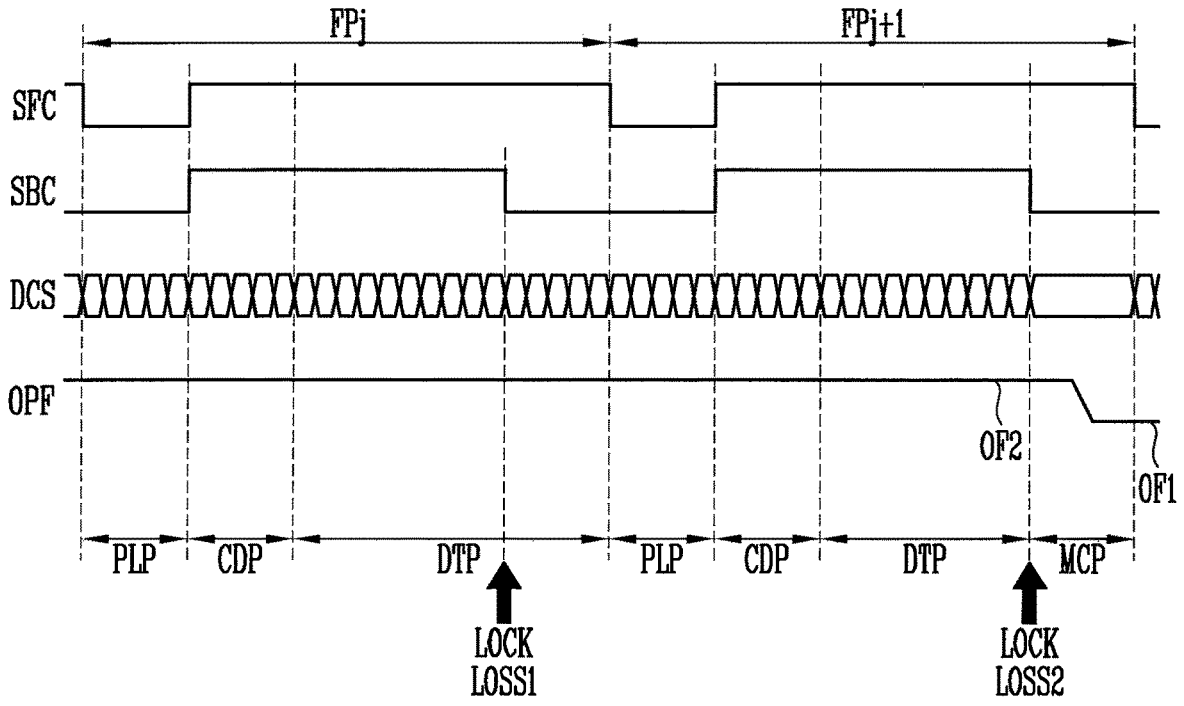

FIG. 6 is a waveform diagram illustrating the driving method shown in FIG. 5.

Figure 7A:
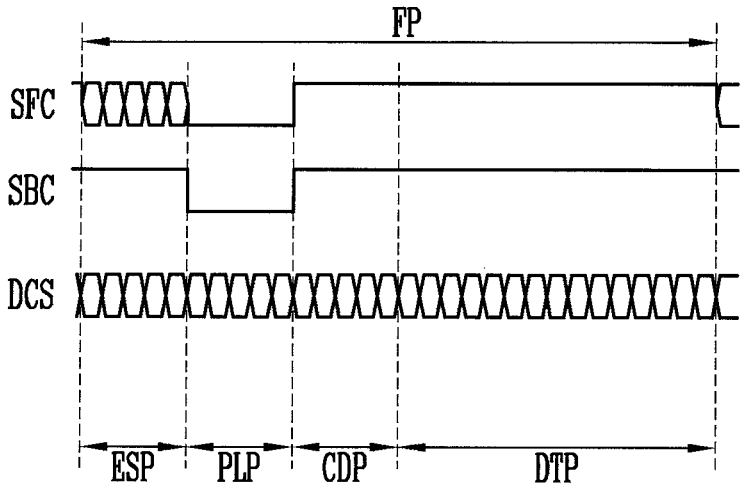
Figure 7B:
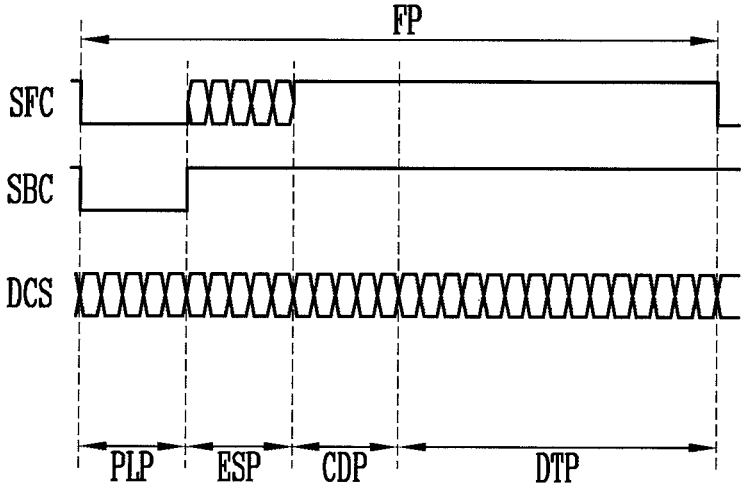

FIGS. 7A and 7B are waveform diagrams illustrating driving methods of the display device according to embodiments of the present disclosure.

DETAILED DESCRIPTION

In the following detailed description, only certain exemplary embodiments of the present disclosure have been shown and described, simply by way of illustration. As those skilled in the art would realize, the described embodiments may be modified in various different ways, all without departing from the spirit or scope of the present disclosure. Accordingly, the drawings and description are to be regarded as illustrative in nature and not restrictive.

Like numbers refer to like elements throughout, and duplicative descriptions thereof may not be provided. The thicknesses, ratios, and dimensions of elements may be exaggerated in the drawings for clarity. As used herein, the term "and/or" includes any and all combinations of one or more of the associated listed items.

It will be understood that, although the terms "first," "second," etc. may be used herein to describe one or more elements, these terms should not be construed as limiting such elements. These terms are only used to distinguish one element from another element. Thus, a first element could be alternately termed a second element without departing from the spirit and scope of the present disclosure. Similarly, a second element could be alternately termed a first element.

Singular forms of terms are intended to include the plural forms as well, unless the context clearly indicates otherwise.

Moreover, spatially relative terms, such as "beneath," "below," "lower," "above," "upper," and the like may be used herein for ease of description to describe one element's spatial relationship to another element(s) as illustrated in the drawings. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be further understood that the terms "includes" and "including," when used in this disclosure, specify the presence of stated features, integers, acts, operations, elements, and/or components, but do not preclude the presence or addition of one or more other features, integers, steps, operations, elements, components, and/or groups thereof.

In the entire specification, when an element is referred to as being "connected" or "coupled" to another element, it can be directly connected or coupled to the another element or be indirectly connected or coupled to the another element with one or more intervening elements interposed therebetween. Further, some of the elements that are not essential to the complete understanding of the disclosure are omitted for clarity. Also, like reference numerals refer FIG. 1 is a diagram illustrating a display device 10 according to an embodiment of the present disclosure.

Referring to FIG. 1, the display device 10 according to the embodiment of the present disclosure may include a timing controller 110, a data driver 120, a scan driver 130, and a display unit 140.

The timing controller 110 may receive image data IDAT and an external control signal CS, which are transmitted from an exterior thereof (e.g., from a host device).

The timing controller 110 may generate a scan control signal SCS for controlling the scan driver 130, and may generate a data control signals DCS for controlling the data driver 120, and may do so based on the image data IDAT and the external control signal CS.

The data control signals DCS may include at least one of a training signal, a set signal, and a data signal. The training signal may have a clock training pattern.

The set signal may be a signal representing an operational characteristic of the data driver 120. For example, the set signal may include a signal recovery characteristic value representing a characteristic of a signal recovery operation of the data driver 120. The signal recovery characteristic value may represent at least one of DC and AC gains of a signal recovery unit included in the data driver 120.

For example, the set signal may have a set pattern including the signal recovery characteristic value. A data signal may be a signal obtained by converting the image data IDAT to be suitable for specifications of the data driver 120. That is, the timing controller 110 may convert the image data IDATA into the data signal.

The timing controller 110 may supply the data control signals DCS to a data control signal line DSL. For example, the timing controller 110 may sequentially supply the training signal, the set signal, and the data signal to the data control signal line DSL.

That is, during a first period, the timing controller 110 may supply the training signal to the data control signal line DSL. Next, during a second period, the timing controller 110 may supply the set signal to the data control signal line DSL. The timing controller 110 may operate in units of frames, and one frame period may include first to third periods.

The timing controller 110 may transmit a training notification signal SFC to the data driver 120 during the first period so as to notify that the training signal is to be supplied. For example, the training notification signal SFC may be a low-level signal. However, the present disclosure is not limited thereto. In some embodiments, the training notification signal SFC may have a specific pattern.

In some embodiments, the training notification signal SFC may directly have a set pattern representing a signal recover characteristic value. That is, the timing controller 110 may transmit the training notification signal SFC having the set pattern to the data driver 120. The data driver 120 may adjust the signal recover characteristic value based on the training notification signal SFC (e.g., the set pattern) having the set pattern. Also, the data driver 120 may recover the data control signals supplied through the data control signal line DSL according to the adjusted signal recover characteristic value. In relation to this, a driving method of the display device 10 according to an embodiment of the present disclosure will be described in detail with reference to FIGS. 7A and 7B.

Also, in some embodiments, the training notification signal SFC may directly have a clock training pattern.

Hereinafter, the embodiment in which the training notification signal SFC is the low-level signal will be representatively described. However, it will be apparent that the following descriptions may be applied to the embodiment in which the training notification signal SFC directly includes the set pattern or the clock training pattern.

The timing controller 110 may receive a feedback signal SBC from the data driver 120.

The timing controller 110 may operate in any one of a first frequency mode, and a second frequency mode that is different from the first frequency mode. The first frequency mode may mean a mode in which the timing controller 110 operates at a first operating frequency, and the second frequency mode may mean a mode in which the timing controller 110 operates at a second operating frequency that is different from the first operating frequency. For example, the first operating frequency may be lower than the second operating frequency.

For example, the second frequency mode may mean a normal operation mode, and the first frequency mode may mean a mode for setting an operational characteristic before the timing controller 110 enters into the normal operation mode.

The timing controller 110 may change a frequency mode from the first frequency mode to the second frequency mode, or may change the frequency mode from the second frequency mode to the first frequency mode.

In some embodiments, the timing controller 110 may supply a data signal having a specific pattern to the data control signal line DSL while the frequency mode is being changed. For example, the timing controller 110 may supply a data signal having a high or low level to the data control signal line DSL while the frequency mode is being changed.

Also, in some embodiments, the timing controller 110 does not transmit the training notification signal SFC to the data driver 120 while the frequency mode is being changed. This is for the purpose of avoiding or preventing malfunction of the data driver 120.

The data driver 120 may receive the training notification signal SFC from the timing controller 110. Also, the data driver 120 may receive the data control signals DCS from the timing controller 110 through the data control signal line DSL.

The data driver 120 may perform Phase Loop Lock (PLL) based on the training signal. For example, the data driver 120 may perform the PLL according to a driving frequency of the timing controller 110.

Also, the data driver 120 may set an operational characteristic based on the set signal. For example, the data driver 120 may adjust the signal recover characteristic value representing the characteristic of the signal recovery operation based on the set signal.

The data driver 120 may recover a data signal according to the signal recovery characteristic value. The data driver 120 may generate a plurality of data voltages based on the recovered signal.

The data driver 120 may supply the plurality of data voltages to a plurality of data lines D1 to Dm.

In some embodiments, the data driver 120 may transmit driver circuit information using the feedback signal SBC. The driver circuit information may include information on a temperature, an Integrated Circuit (IC) maker or manufacturer, an output delay, a slew rate, and the like. The data driver 120 may time-divisionally transmit, to the timing controller 110, the driver circuit information and whether the PLL has failed by using the feedback signal SBC.

However, in this specification, a case where the feedback signal SBC represents whether the PLL has failed is illustrated for convenience of description. Therefore, when the PLL fails, the data driver 120 may transmit the feedback signal SBC having a low level to the timing controller 110.

The driving method of the display device 10 according to the embodiment of the present disclosure will be described in detail with reference to FIGS. 3 to 6.

The scan driver 130 may supply a plurality of scan signals to a plurality of scan lines S1 to Sn in response to the scan control signal SCS. For example, the scan driver 130 may supply the scan signals to the plurality of scan lines S1 to Sn.

The display unit 140 may include a plurality of pixels PXL that emit lights with gray scales corresponding to the plurality of data voltages, respectively. Each of the plurality of pixels PXL may be coupled to a corresponding data line D1 to Dm and to a corresponding scan line S1 to Sn, and may be supplied with a data voltage and a scan signal through the corresponding data line D1 to Dm and the corresponding scan line S1 to Sn, respectively.

When the display device 10 is an organic light emitting display device, each pixel PXL may include an organic light emitting diode. When the display device 10 is a liquid crystal display device, each pixel PXL may include a liquid crystal layer.

FIG. 2 is a data driver 120 according to an embodiment of the present disclosure.

Referring to FIG. 2, the data driver 120 may include a plurality of driver circuits 200. Each driver circuit 200 may also be referred to as a driver IC or source IC.

Each of the plurality of driver circuits 200 may include a signal recovery unit 210. For example, the signal recovery unit 210 may be an equalizer.

The signal recovery unit 210 may recover the data control signals DCS supplied to the data control signal line DSL according to a signal recovery characteristic value. For example, the signal recovery unit 210 may recover a data signal.

In some embodiments, the signal recovery unit 210 may filter the control signals supplied to the data control signal line DSL according to the signal recover characteristic value.

For example, to remove noise, etc., the signal recovery unit 210 may filter the data control signals DCS according to the signal recovery characteristic value. The signal recovery characteristic value may represent at least one AC and DC gains of a filter.

The timing controller 110 may transmit the training notification signal SFC to the driver circuits 200. Each of the driver circuits 200 may transmit the feedback signal SBC to the timing controller 110. Each of the driver circuits 200 may be respectively coupled to the timing controller 110 through the data control signal line DSL.

The number of data control signal lines DSL corresponding to any one of the driver circuits 200 may be one or more. For example, when the bandwidth of one data control signal line DSL is potentially insufficient, a plurality of dedicated data control lines DSL may be provided in each driver circuit 200 so as to complement this potential insufficiency. In addition, when the dedicated data control signal line DSL is configured as a differential signal line so as to remove common mode noise, each driver circuit 200 may require even data control signal lines.

FIG. 3 is a flowchart illustrating a driving method of the display device 10 according to an embodiment of the present disclosure.

Referring to FIGS. 1 to 3, the display device 10 of the present disclosure may operate as follows according to an embodiment.

In this specification, a first set signal may mean a set signal that the timing controller 110 supplies to the data control signal line DSL in the first frequency mode, and a second set signal may be a set signal that the timing controller 110 supplies to the data control signal in the second frequency mode.

In operation S100, the timing controller 110 may operate in the first frequency mode. That is, the timing controller 110 may operate in the first frequency mode so as to set an operational characteristic (e.g., a signal recovery characteristic).

In operation S110, a signal recovery characteristic value may be adjusted. For example, the timing controller 110 may supply the first set signal to the data control signal line DSL. The data driver 120 may adjust the signal recovery characteristic value based on the first set signal.

In operation S120, a frequency mode may be changed. For example, the timing controller 110 may change the frequency mode from the first frequency mode to the second frequency mode.

In operation S130, the timing controller 110 may operate in the second frequency mode. For example, the timing controller 110 may operate in the second frequency mode for the purpose of a normal operation.

In operation S140, the signal recovery characteristic value may be again adjusted. For example, in the second frequency mode, the timing controller 110 may supply a second set signal to the data control signal line DSL. The data driver 120 may again adjust the signal recovery characteristic value based on the second set signal.

In operation S150, the timing controller 110 may normally operate. For example, in the second frequency mode, the timing controller 110 may supply a data signal to the data control signal line DSL. The data driver 120 may recover the data signal according to the adjusted signal recovery characteristic value. Also, the data driver 120 may generate a plurality of data voltages based on the recovered data signal.

When external damage (e.g., Electro Static Discharge (ESD)) occurs while the timing controller 110 is normally operating, PLL may fail. When the PLL does not fail (e.g., "NO" in operation S160), the display device 10 may operate according to operations S130, S140, and S150.

Meanwhile, when the PLL fails (e.g., "YES" in operation S160), the display device 10 may operate according to operation S170.

In the operation S170, the timing controller 110 may change the frequency mode. For example, the timing controller 110 may change the frequency mode from the second frequency mode to the first frequency mode. After this, the operation S100 may continue.

Thus, in the display device 10 and the driving method thereof according to the embodiment of the present disclosure, when the PLL fails, the signal recovery characteristic value is adjusted by changing the frequency mode so that a signal recovery rate can be improved.

FIGS. 4A and 4B are waveform diagrams illustrating the driving method of the display device 10, which is shown in FIG. 3.

FIG. 4A illustrates the driving method of the display device 10 when the display device 10 is power on.

Referring to FIGS. 1 and 4A, the timing controller 110 of the display device 10 may operate in units of frames.

For convenience of description, FIG. 4A illustrates a first frame period FP1 and a second frame period FP2.

When the display device 10 is powered on, the timing controller 110 first operates in the first frequency mode. In the first frequency mode, the operating frequency OPF of the timing controller 110 may have a first operating frequency value OF1.

The first frame period FP1 may include a first period PLP, a second period CDP, a third period DTP, and a fourth period MCP.

The first period PLP of the first frame period FP1 may be a period for PLL. During the first period PLP of the first frame period FP1, the timing controller 110 may transmit a training notification signal SFC to the data driver 120. The PLL has not been performed, and hence the data driver 120 may transmit a feedback signal SBC to the timing controller 110. The timing controller 110 may neglect or ignore the feedback signal SBC. Also, the timing controller 110 may supply a training signal to the data control signal line DSL, and the data driver 120 may perform the PLL based on the training signal.

The second period CDP of the first frame period FP1 may be a period for transmitting a set signal. During the second period CDP of the first frame period FP1, the timing controller 110 may supply a first set signal to the data control signal line DSL, and the data driver 120 may adjust a signal recovery characteristic value based on the first set signal. For example, the signal recovery characteristic value may represent at least one of DC and AC gains of the signal recovery unit 210 (see FIG. 2) of the data driver 120.

The third period DTP of the first frame period FP1 may be a period for transmitting a data signal. During the third period DTP of the first frame period FP1, the timing controller 110 may supply a data signal to the data control signal line DSL. The data signal may have a dummy pattern.

The fourth period MCP of the first frame period FP1 may be a period for changing a frequency mode. During the fourth period MCP of the first frame period FP1, the data driver 120 may transmit the feedback signal SBC to the timing controller 110. The timing controller 110 may change a frequency mode from the first frequency mode to the second frequency mode. Accordingly, the operating frequency OPF of the timing controller 110 is changed from the first operating frequency value OF1 to a second operating frequency value OF2.

In some embodiments, the timing controller 110 may supply a data signal having a specific pattern to the data control signal line DSL while the frequency mode is being changed. For example, the timing controller 110 may supply a data signal having a high or low level to the data control signal line DSL while the frequency mode is being changed. Also, in some embodiments, the timing controller 110 does not transmit the training notification signal SFC to the data driver while the frequency mode is being changed. This is for the purpose of avoiding or preventing malfunction of the data driver 120.

The second frame period FP2 may include a first period PLP, a second period CDP, and a third period DTP.

The first period PLP of the second frame period FP2 may be a period for PLL. During the first period PLP of the second frame period FP2, the timing controller 110 may transmit the training notification signal SFC to the data driver 120. When the data driver 120 receives the training notification signal SFC, the data driver 120 may release the existing PLL to again perform the PLL. The data driver 120 may transmit the feedback signal SBC to the timing controller 110. The timing controller 110 may supply a training signal to the data control signal line DSL, and the data driver 120 may perform the PLL based on the training signal.

The second period CDP of the second frame period FP2 may be a period for transmitting a set signal. During the second period CDP of the second frame period FP2, the timing controller 110 may supply a second set signal to the data control signal line DSL, and the data driver 120 may again adjust a signal recovery characteristic value based on the second set signal. In some embodiments, the signal recovery characteristic value included in the first set signal may be equal to that included in the first set signal.

The third period DTP of the second frame period FP2 may be a period for transmitting a data signal. During the third period DTP of the second frame period FP2, the timing controller 110 may supply a data signal to the data control signal line DSL. The data driver 120 may recover the data signal according to the adjusted signal recovery characteristic value. Subsequently, the data driver 120 may generate a plurality of data voltages based on the recovered data signal.

FIG. 4B illustrates the driving method of the display device 10 when the PLL fails while the display device 10 is normally operating.

Referring to FIGS. 1 and 4B, the timing controller 110 of the display device 10 may operate in units of frames.

For convenience of description, FIG. 4B illustrates an ith (i is a natural number) frame period FPi, an (i+1)th frame period FPi+1, and an (i+2)th frame period FPi+2.

When the display device normally operates, the timing controller 110 may operate in the second frequency mode. In the second frequency mode, the operating frequency OPF of the timing controller 110 may have the second operating frequency value OF2.

When the PLL fails (e.g., at the point indicated by "LOCK LOSS" in FIG. 4B) while the display device 10 is normally operating, the data driver 120 may feed whether the PLL has failed back to the timing controller 110 using the feedback signal SBC. For example, during a fourth period MCP of the ith frame FPi, the data driver 120 may transmit the feedback signal having a low level to the timing controller 110. The timing controller 110 may change a frequency mode from the second frequency mode to the first frequency mode. Accordingly, the operating frequency OPF of the timing controller 110 is changed from the second operating frequency value OF2 to the first operating frequency value OF1.

In some embodiments, the timing controller 1100 may supply a data signal having a specific pattern to the data control signal line DSL while the frequency mode is being changed. For example, the timing controller 110 may supply a data signal having a high or low level to the data control signal line DSL while the frequency mode is being changed. Also, in some embodiments, the timing controller 110 does not transmit the training notification signal SFC to the data driver 120 while the frequency mode is being changed. This is for the purpose of avoiding or preventing malfunction of the data driver 120.

The (i+1)th frame period FPi+1 may include a first period PLP, a second period CDP, a third period DTP, and a fourth period MCP.

The first period PLP of the (i+1)th frame period FPi+1 may be a period for PLL. During the first period PLP of the (i+1)th frame period FPi+1, the timing controller 110 may transmit the training notification signal SFC to the data driver 120. When the data driver 120 receives the training notification signal SFC, the data driver 120 may release the existing PLL to again perform the PLL, and the data driver 120 may transmit the feedback signal SBC to the timing controller 110. The timing controller 110 may supply a training signal to the data control signal line DSL, and the data driver 120 may perform the PLL based on the training signal.

The second period CDP of the (i+1)th frame period FPi+1 may be a period for transmitting a set signal. During the second period CDP of the (i+1)th frame period FPi+1, the timing controller 110 may supply a first set signal to the data control signal line DSL, and the data driver 120 may adjust a signal recovery characteristic value based on the first set signal. For example, the signal recovery characteristic value may represent at least one of DC and AC gains of the signal recovery unit 210 (see FIG. 2) of the data driver 120.

The third period DTP of the (i+1)th frame period FPi+1 may be a period for transmitting a data signal. During the third period DTP of the (i+1)th frame period FPi+1, the timing controller 110 may supply a data signal to the data control signal line DSL. The data signal may have a dummy pattern.

The fourth period MCP of the (i+1)th frame period FPi+1 may be a period for changing a frequency mode. During the fourth period MCP of the (i+1)th frame period FPi+1, the data driver 120 may transmit a feedback signal SBC to the timing controller 110. The timing controller 110 may change a frequency mode from the first frequency mode to the second frequency mode. Accordingly, the operating frequency OPF of the timing controller 110 is changed from the first operating frequency value OF1 to a second operating frequency value OF2.

The (i+2)th frame period FPi+2 may include a first period PLP, a second period CDP, and a third period DTP.

The first period PLP of the (i+2)th frame period FPi+2 may be a period for PLL. During the first period PLP of the (i+2)th frame period FPi+2, the timing controller 110 may transmit the training notification signal SFC to the data driver 120. When the data driver 120 receives the training notification signal SFC, the data driver 120 may release the existing PLL to again perform the PLL, and the data driver 120 may transmit the feedback signal SBC to the timing controller 110. The timing controller 110 may supply a training signal to the data control signal line DSL, and the data driver 120 may perform the PLL based on the training signal.

The second period CDP of the (i+2)th frame period FPi+2 may be a period for transmitting a set signal. During the second period CDP of the (i+2)th frame period FPi+2, the timing controller 110 may supply a second set signal to the data control signal line DSL, and the data driver 120 may again adjust a signal recovery characteristic value based on the second set signal. In some embodiments, the signal recovery characteristic value included in the first set signal may be equal to that included in the first set signal.

The third period DTP of the (i+2)th frame period FPi+2 may be a period for transmitting a data signal. During the third period DTP of the (i+2)th frame period FPi+2, the timing controller 110 may supply a data signal to the data control signal line DSL. The data driver 120 may recover the data signal according to the adjusted signal recovery characteristic value. Subsequently, the data driver 120 may generate a plurality of data voltages based on the recovered data signal.

FIG. 5 is a flowchart illustrating a driving method of the display device according to an embodiment of the present disclosure.

Referring to FIGS. 1 to 5, the display device 10 of the present disclosure may operate as follows according to another embodiment.

The driving method shown in FIG. 5 is identical to that of FIG. 3 with respect to operations S100 to S150. Therefore, overlapping descriptions will be omitted to avoid redundancy.

In the operation S150, the timing controller 110 may normally operate. When external damage (e.g., Electro Static Discharge (ESD)) occurs while the timing controller 110 is normally operating, PLL may fail.

When the PLL does not fail (e.g., "NO" in operation S160), the display device 10 may operate according to operations S130, S140, and S150.

Meanwhile, when the PLL fails (e.g., "YES" in operation S160), unlike the driving method shown in FIG. 3, the display device 10 may operate according to operation S170.

In the operation S170, the timing controller 110 may operate in the second frequency mode. That is, the timing controller 110 may operate in the second frequency mode for the purpose of a normal operation.

In operation S180, the signal recovery characteristic value may be again adjusted. For example, in the second frequency mode, the timing controller 110 may supply a second set signal to the data control signal line DSL. The data driver 120 may again adjust the signal recovery characteristic value based on the second set signal.

In operation S190, the timing controller 110 may normally operate. For example, in the second frequency mode, the timing controller 110 may supply a data signal to the data control signal line DSL. The data driver 120 may recover the data signal according to the adjusted signal recovery characteristic value. Subsequently, the data driver 120 may generate a plurality of data voltages based on the recovered data signal.

When the PLL does not fail (e.g., "NO" in operation S200), the display device 10 may operate according to operations S130, S140, and S150.

Meanwhile, when the PLL fails (e.g., "YES" in operation S200), the display device 10 may operate according to operation S210.

In the operation S210, the timing controller 110 may change the frequency mode. For example, the timing controller 110 may change the frequency mode from the second frequency mode to the first frequency mode. After this (e.g., once PLL has failed twice), the operation S100 may be continued.

Thus, in the display device 10 and the driving method thereof according to the embodiment of the present disclosure, when the PLL fails, the signal recovery characteristic value is adjusted by changing the frequency mode, so that a signal recovery rate can be improved. Further, in the driving method shown in FIG. 5, the number where the frequency mode is changed can be decreased as compare with the driving method shown in FIG. 3.

FIG. 6 is a waveform diagram illustrating the driving method of the display device 10, which is shown in FIG. 5.

FIG. 6 illustrates the driving method of the display device 10 when PLL fails while the display device 10 is normally operating.

For convenience of description, FIG. 6 illustrates a jth (j is a natural number of 2 or more) frame period FPj and a (j+1)th frame period FPj+1.

When the display device 10 normally operates, the timing controller 110 may operate in the second frequency mode. In the second frequency mode, the operating frequency OPF of the timing controller 110 may have the second operating frequency value OF2.

The jth frame period FPj may include a first period PLP, a second period CDP, and a third period DTP.

The first period PLP of the jth frame period FPj may be a period for PLL. During the first period PLP of the jth frame period FPj, the timing controller 110 may transmit a training notification signal SFC to the data driver 120. When the data driver 120 receives the training notification signal SFC, the data driver 120 may release the existing PLL to again perform the PLL. The data driver 120 may transmit a feedback signal SBC to the timing controller 110. The timing controller 110 may supply a training signal to the data control signal line DSL, and the data driver 120 may perform the PLL based on the training signal.

The second period CDP of the jth frame period FPj may be a period for transmitting a set signal. During the second period CDP of the jth frame period FPj, the timing controller 110 may supply a second set signal to the data control signal line DSL, and the data driver 120 may adjust a signal recovery characteristic value based on the second set signal. For example, the signal recovery characteristic value may represent at least one of DC and AC gains of the signal recovery unit 210 (see FIG. 2) of the data driver 120.

The third period DTP of the jth frame period FPj may be a period for transmitting a data signal. During the third period DTP of the jth frame period FPj, the timing controller 110 may supply a data signal to the data control signal line DSL. The data driver 120 may recover the data signal according to the adjusted signal recovery characteristic value. Subsequently, the data driver 120 may generate a plurality of data voltages based on the recovered data signal.

When the PLL primarily fails (e.g., at "LOCK LOSS1" in FIG. 6) while the display device 10 is normally operating, the data driver 120 may feed whether the PLL has failed back to the timing controller 110 using the feedback signal SBC. For example, when the PLL primarily fails (LOCK LOSS 1), the data driver 120 may transmit the feedback signal SBC having a low level to the timing controller 110.

The timing controller 110 might not change a frequency mode from the second frequency mode to the first frequency mode at this point. Accordingly, the operating frequency OPF of the timing controller 110 continues to have the second operating frequency value OF2.

The (j+1)th frame period FPj+1 may include a first period PLP, a second period CDP, a third period DTP, and a fourth period MCP.

The first period PLP of the (j+1)th frame period FPj+1 may be a period for PLL. During the first period PLP of the (j+1)th frame period FPj+1, the timing controller 110 may transmit the training notification signal SEC to the data driver 120. When the data driver 120 receives the training notification signal SFC, the data driver 120 may release the existing PLL to again perform the PLL. The data driver 120 may transmit the feedback signal SBC to the timing controller 110. The timing controller 110 may supply a training signal to the data control signal line DSL, and the data driver 120 may perform the PLL based on the training signal.

The second period CDP of the (j+1)th frame period FPj+1 may be a period for transmitting a set signal. During the second period CDP of the (j+1)th frame period FPj+1, the timing controller 110 may supply a second set signal to the data control signal line DSL, and the data driver 120 may adjust a signal recovery characteristic value based on the second set signal.

The third period DTP of the (j+1)th frame period FPj+1 may be a period for transmitting a data signal. During the third period DTP of the (j+1)th frame period FPj+1, the timing controller 110 may supply a data signal to the data control signal line DSL. The data driver 120 may recover the data signal according to the adjusted signal recovery characteristic value. Subsequently, the data driver 120 may generate a plurality of data voltages based on the recovered data signal.

When the PLL secondarily fails (e.g., at "LOCK LOSS2" in FIG. 6) while the display device 10 is normally operating, the data driver 120 may feed whether the PLL has failed back to the timing controller 110 using the feedback signal SBC.

The fourth period MCP of the (j+1)th frame period FPj+1 may be a period for changing a frequency mode. When the PLL secondarily fails (LOCK LOSS 2), during the fourth period MCP of the (j+1)th frame period FPj+1, the data driver 120 may transmit the feedback signal SBC having a low level to the timing controller 110. The timing controller may change the frequency mode from the second frequency mode to the first frequency mode. Accordingly, the operating frequency OPF of the timing controller 110 is changed from the second operating frequency value OF2 to the first operating frequency OF1.

In some embodiments, the timing controller 1100 may supply a data signal having a specific pattern to the data control signal line DSL while the frequency mode is being changed. For example, the timing controller 110 may supply a data signal having a high or low level to the data control signal line DSL while the frequency mode is being changed. Also, in some embodiments, the timing controller 110 does not transmit the training notification signal SFC to the data driver 120 while the frequency mode is being changed. This is for the purpose of avoiding or preventing malfunction of the data driver 120.

FIGS. 7A and 7B are waveform diagrams illustrating driving methods of the display device according to embodiments of the present disclosure.

FIG. 7A illustrates a driving method of the display device according to an embodiment.

Referring to FIGS. 1 and 7A, the timing controller 110 of the display device 10 may operate in units of frames.

For convenience of description, FIG. 7A illustrates an arbitrary frame period FP. The frame period FP may include a set period ESP, a first period PLP, a second period CDP, and a third period DTP.

The set period ESP may be a period for setting a signal recovery characteristic value of the signal recovery unit 210 (see FIG. 2). During the set period ESP, the timing controller 110 may transmit a training notification signal SFC having a set pattern to the data driver 120. The set pattern may include a signal recovery characteristic value. The data driver 120 may adjust the signal recovery characteristic value based on the set pattern included in the training notification signal SFC. For example, the signal recovery characteristic value may represent at least one of DC and AC gains of the signal recovery unit 210 (see FIG. 2) of the data driver 120.

The first period PLP may be a period for PLL. During the first period PLP, the timing controller 110 may transmit the training notification signal SFC to the data driver 120. The training notification signal SFC may be a signal having a low level. When the data driver 120 receives the training notification signal SFC, the data driver 120 may release the existing PLL to perform the PLL. Accordingly, the data driver 120 transmits a feedback signal SBC to the timing controller 110.

During the first period PLP, the timing controller 110 may supply a training signal to the data control signal line DSL, and the data driver 120 may perform the PLL based on the training signal.

The second period CDP may be a period for transmitting a set signal. During the second period CDP, the timing controller 110 may supply a set signal to the data control signal line DSL, and the data driver 120 may adjust a driving setting of the data driver 120 based on the set signal.

The third period DTP may be a period for transmitting a data signal. During the third period DTP, the timing controller 110 may supply a data signal to the data control signal line DSL. The data driver 120 may recover the data signal according to the adjusted signal recovery characteristic value. Subsequently, the data driver 120 may generate a plurality of data voltages based on the recovered data signal.

FIG. 7B illustrates a driving method of the display device according to another embodiment.

For convenience of description, FIG. 7B illustrates an arbitrary frame period FP. In the driving method shown in FIG. 7B, portions different from those of the driving method shown in FIG. 7A will be mainly described to avoid redundancy.

The frame period FP shown in FIG. 7B may include a first period PLP, a set period ESP, a second period CDP, and a third period DTP.

That is, unlike the frame period FP shown in FIG. 7A, the set period ESP may be located between the first period PLP and the second period CDP.

The first period PLP is a period for PLL, and may be substantially identical to the first period PLP of FIG. 7A. Similarly, the set period ESP, the second period CDP, and the third period DTP may be respectively substantially identical to the set period ESP, the second period CDP, and the third period DTP of FIG. 7A.

According to the present disclosure, the display device and the driving method thereof can improve a signal recovery rate.

Embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, with functional equivalents thereof to be included.

What is claimed is:

1. A display device comprising:

a timing controller configured to supply a first set signal to a data control signal line in a first frequency mode, and to supply a second set signal and a data signal to the data control signal line in a second frequency mode that is different from the first frequency mode;

a data driver configured to recover the data signal supplied to the data control signal line according to a signal recovery characteristic value, to generate a plurality of data voltages based on the recovered data signal, and to adjust the signal recovery characteristic value based on the first set signal and the second set signal; and a display unit comprising a plurality of pixels that emit lights with gray scales corresponding to the plurality of data voltages, wherein the signal recovery characteristic value represents at least one of DC and AC gains of the signal recovery unit.

2. The display device of claim 1, wherein a first operating frequency in the first frequency mode is lower than a second operating frequency in the second frequency mode.

3. The display device of claim 1, wherein the timing controller is configured to the data signal having a high or low level to the data control signal line while a frequency mode is being changed.

4. The display device of claim 1, wherein the timing controller is configured to transmit a training notification signal to the data driver before the first and second set signals are transmitted to the data control signal line.

5. The display device of claim 4, wherein the timing controller does not transmit the training notification signal to the data driver while a frequency mode is being changed.

6. The display device of claim 1, wherein the data driver is configured to indicate to the timing controller whether Phase Loop Lock (PLL) has failed using a feedback signal.

7. The display device of claim 6, wherein the timing controller is configured to change a frequency mode from the second frequency mode to the first frequency mode when the feedback signal is received.

8. The display device of claim 6, wherein the timing controller is configured to continue to operate in the second frequency mode when the feedback signal is received, and to change the frequency mode from the second frequency mode to the first frequency mode when the feedback signal is again received.

9. The display device of claim 1, wherein the data driver comprises a plurality of driver circuits configured to supply the plurality of data voltages to the plurality of pixels, and wherein each of the plurality of driver circuits comprises a signal recovery unit configured to recover a signal supplied to the data control signal line.

10. The display device of claim 9, wherein the signal recovery unit is configured to recover data control signals supplied to the data control signal line by filtering the data control signals according to the signal recovery characteristic value.

11. A method for driving a display device, the method comprising:

supplying, by a timing controller, a first set signal to a data control signal line in a first frequency mode;

adjusting, by a data driver, a signal recovery characteristic value based on the first set signal;

changing, by the timing controller, a frequency mode from the first frequency mode to a second frequency mode that is different from the first frequency mode;

supplying, by the timing controller, a second set signal and a data signal to the data control signal line in the second frequency mode;

again adjusting the signal recovery characteristic value based on the second set signal;

recovering, by the data driver, the data signal according to the signal recovery characteristic value;

generating, by the data driver, a plurality of data voltages based on the recovered data signal; and emitting, from a plurality of pixels, lights with gray scales corresponding to the plurality of data voltages, wherein the signal recovery characteristic value represents at least one of DC and AC gains of the signal recovery unit.

12. The method of claim 11, wherein a first operating frequency in the first frequency mode is lower than a second operating frequency in the second frequency mode.

13. The method of claim 11, further comprising supplying, with the timing controller, a data signal having a high or low level to the data control signal line while a frequency mode is being changed.

14. The method of claim 11, further comprising transmitting, with the timing controller, a training notification signal to the data driver before the first and second set signals are transmitted to the data control signal line.

15. The method of claim 14, wherein the timing controller does not transmit the training notification signal to the data driver while the frequency mode is being changed.

16. The method of claim 11, further comprising indicating with a feedback signal, from the data driver to the timing controller, whether Phase Loop Lock (PLL) has failed.

17. The method of claim 16, further comprising changing, by the timing controller, the frequency mode from the second frequency mode to the first frequency mode when the feedback signal is received.

18. The method of claim 16, further comprising having the timing controller operate in the second frequency mode when the feedback signal is received, and change the frequency mode from the second frequency mode to the first frequency mode when the feedback signal is again received.

19. A display device comprising:

a timing controller configured to transmit a training notification signal having a first set pattern to a data control signal line in a first frequency mode, and to supply the training notification signal having a second set pattern and a data signal to the data control signal line in a second frequency mode that is different from the first frequency mode;

a data driver configured to recover the data signal supplied to the data control signal line according to a signal recovery characteristic value, to generate a plurality of data voltages based on the recovered data signal, and to adjust the signal recovery characteristic value based on the first set pattern and the second set pattern; and a display unit comprising a plurality of pixels configured to emit lights with gray scales corresponding to the plurality of data voltages;

wherein the signal recovery characteristic value represents at least one of DC and AC gains of the signal recovery unit.

* * * * *